US005699971A

United States Patent [19]

Špindler et al.

[11] Patent Number: 5,699,971

[45] Date of Patent: Dec. 23, 1997

[54] METHOD OF, AND DEVICE FOR, DETECTING THE YARN END ON A BOBBIN

[75] Inventors: Zdeněk Špindler, B. Němcové ; Vojtěch Novotný , Dukelské ; Petr Semrád, Eduarda Beneše, all of Czech Rep.

[73] Assignee: Rieter Elitex a.s., Czech Rep.

[21] Appl. No.: 615,389

[22] Filed: Mar. 14, 1996

[30] Foreign Application Priority Data

Mar. 14, 1995 [CZ] Czech Rep. ..... 660-95

[51] Int. Cl.[6] ..... B65H 69/04; D01H 13/04

[52] U.S. Cl. ..... 242/35.6 E; 57/261

[58] Field of Search ..... 242/35.6 E, 35.5 A, 242/35.5 R, 35.6 R, 18 R; 57/261, 263

[56] References Cited

U.S. PATENT DOCUMENTS

| | | | |
|---|---|---|---|
| 4,644,742 | 2/1987 | Lovas et al. | 57/263 |
| 4,723,720 | 2/1988 | Matsui et al. | 242/35.6 E X |
| 4,891,933 | 1/1990 | Raasch | 57/263 X |
| 5,170,953 | 12/1992 | Stahlecker | 242/25.6 E X |
| 5,426,929 | 6/1995 | Schwalm et al. | 242/35.6 E X |

*Primary Examiner*—Michael Mansen

*Attorney, Agent, or Firm*—Ostrolenk, Faber, Gerb & Soffen, LLP

[57] ABSTRACT

A method and device for detecting the yarn end on a bobbin in a textile machine. The textile machine comprises a plurality of operating units situated next to each other and an attending device adapted to travel along the units and to stop at a selected one of the operating units. The attending device includes a selecting device provided with a detecting nozzle having a yarn sucking mouth. The detecting device is displaced into a detecting position in which the mouth of the detecting nozzle lies in the path of possible motion of a central tube of the bobbin. The bobbin begins to move towards the mouth of the detecting nozzle situated in its detecting position onto which the bobbin circumference comes to lie. The mouth of the detecting nozzle then moves in the direction of the bobbin motion whereupon the bobbin stops and then begins to move in the reverse direction while the mouth of the detecting nozzle remains in contact with the bobbin circumference up to the return of the detecting nozzle into its detecting position where the mouth of the detecting nozzle stops. The moment that contact is lost between the bobbin circumference and the mouth of the detecting nozzle is monitored. The bobbin moves from the detecting position for a given time interval, ensuring a constant distance between the bobbin circumference and the mouth of the detecting nozzle, regardless of the yarn winding diameter on the bobbin.

16 Claims, 3 Drawing Sheets

METHOD OF, AND DEVICE FOR, DETECTING THE YARN END ON A BOBBIN

BACKGROUND OF THE INVENTION

1. Technical Field

The invention relates to a method of detecting the yarn end on a bobbin, which is seated by the central tube of the bobbin being supported in the arms of a winding device of an operating unit of a textile machine, in particular an open-end spinning machine. The machine comprises a plurality of operating units that are situated next to each other and an attending device that is adapted to travel along the operating units and to stop at a selected one of the operating units. The detecting unit is fitted with a detecting device provided with a detecting nozzle.

The invention also relates to an attending device of a textile machine for carrying out the method. The machine comprises a bobbin yarn end detecting device, which is adapted to move towards the machine and back again and which contains a swinging arm with a detecting nozzle on it that is adapted to be connected at an operator's choice to an underpressure source. At its extremity, the nozzle includes a mouth for sucking the yarn end. The attending device also comprises means for handling the winding arms of the winding device of the operating unit being attended which support the bobbin and are used to place the bobbin selectively nearer to or farther from the mouth of the detecting nozzle.

2. Background Art

In spinning machines, yarn is spun by being wound on bobbins located at each of a plurality of spinning stations situated next to each other.

For detecting the yarn end on a supported bobbin after a yarn rupture or another interruption of the spinning process resulting in yarn rupture, the machines include attending devices each of which is equipped with a detecting nozzle having a mouth that is adapted to be moved into the vicinity of the circumference of the winding of the supported bobbin at which there has been a yarn rupture.

To increase the probability of the detecting nozzle successfully detecting the yarn end, it is desirable to keep the distance between the nozzle mouth and the circumference of the bobbin winding constant, irrespective of the diameter of the bobbin winding at a particular time in a particular case.

DE OS 38 27 345 and its corresponding U.S. Pat. No. 5,170,953 solve this problem by using an attending device that is equipped with an auxiliary drive cylinder which is put into contact with the supported bobbin and can impart rotation to the bobbin both in the winding and the unwinding directions. The attending device also contains a yarn detecting nozzle having a mouth that is adapted to be moved into the vicinity of the circumference of the winding of the supported bobbin. The detecting nozzle is coupled with a servo drive for moving the detecting nozzle into a position in the immediate vicinity of the bobbin circumference. The disclosed invention provides means on the attending device that adapt the position of the detecting nozzle to the particular diameter of the bobbin (winding) in question. Those means monitor the bobbin (winding) diameter and adapt the motion of the detecting nozzle towards the bobbin circumference so that the servo drive stops the motion of the detecting nozzle each time at a constant distance from the bobbin circumference. The means monitoring the bobbin (winding) diameter can be located either on the attending device or on each operating unit of the machine.

The drawback of this device consists in the great complexity of its design which results in high cost and involves the risk of troubling incidents. The attending device must include connections between the means that monitor the diameter of the bobbin winding and the servo drive of the detecting nozzle, while the servo drive requires complicated means that permit exact monitoring of the position of the detecting nozzle while it moves towards the bobbin circumference, as well as means permitting the motion of the detecting nozzle to stop at a predetermined position.

In addition, the necessity to measure the diameter of the bobbin winding increases the length of the operation cycle of the attending device. Besides, the precision of the measurement of the bobbin winding diameter by the means situated on the attending device can be adversely affected by differences in the bobbin lifting. As a result, the position of the bobbin arms must also be monitored by additional means which further increase the complexity of the device and reduce its reliability.

A simplified design of the attending device is provided in the exemplary embodiment disclosed in DE OS 38 27 345 (U.S. Pat. No. 5,170,953) by first bringing the detecting nozzle into contact with the circumference of the supported bobbin. That such a position has been reached is monitored by a suitable sensor. After that contact has been established, the drive moves the detecting nozzle in the opposite direction by a predetermined angle value that has been preset in the drive.

The drawback of this method is that the real position of the detecting nozzle is not constant after it has come into contact with the circumference of the bobbin, because it is co-determined by the stiffness of the winding on the bobbin as well as by the size of the contact surface of the mouth of the detecting nozzle. Since the length of the path preset for the reverse motion of the detecting nozzle is small and since the detecting nozzle, in particular for soft yarn windings on a bobbin, is partially pressed into the windings when the nozzle comes into contact with the yarn windings, the preset distance between the detecting nozzle and the bobbin circumference is liable to fluctuations in practical operation thus reducing the reliability of the bobbin yarn end detection. For hard bobbin yarn windings, the impact of the detecting nozzle risks damage to the outer layer of the yarn winding.

SUMMARY OF THE INVENTION

The object of the invention is to remove the above drawbacks and to provide a method of reliably setting the mouth of the detecting nozzle at a constant distance from the circumference of the bobbin regardless of the diameter of the bobbin winding and without having to monitor the bobbin diameter.

Another object of the invention is to provide a device for carrying out the method, permitting the detecting nozzle to move in a simple manner towards the bobbin circumference, without using means for measuring the bobbin diameter, to set the mouth of the detecting nozzle each time at a constant distance from the bobbin circumference.

Drawbacks of the prior art are removed by the inventive method of detecting the yarn end on a bobbin seated by means of its tube in the arms of a winding device of an operating unit of a textile machine. The machine comprises the following elements. A plurality of operating units are situated next to each other. An attending device is adapted to travel along the operating units and to stop at a selected one of the operating units. The attending device is fitted with a detecting device, which is adapted to move towards the machine and back and is provided with a detecting nozzle having a yarn suction mouth at its extremity.

According to the invention, the detecting device is displaced into a detecting position in which the mouth of the detecting nozzle lies in the path of possible motion of the bobbin support tube. The bobbin mounted in the arms of the winding device begins to move towards the mouth of the detecting nozzle which is situated in its detecting position and the bobbin circumference comes to lie on the mouth of the nozzle. The mouth of the detecting nozzle then moves slightly in the direction of and along with the bobbin motion, whereupon the bobbin stops moving in the one direction and then begins to move in the reverse direction while the mouth of the detecting nozzle uninterruptedly remains in contact with the bobbin circumference until the detecting nozzle returns into its original detecting position where the mouth of the detecting nozzle stops moving. The moment of the loss of contact between the still moving bobbin circumference and the halted mouth of the detecting nozzle is monitored. The bobbin continues moving to its own detecting position away from the nozzle mouth for a time interval. This repeatedly ensures that there is a constant distance between the bobbin circumference and the mouth of the detecting nozzle regardless of the bobbin yarn winding diameter.

The advantage of the method herein disclosed is particularly that the mouth of the detecting nozzle initially moves in the direction of the bobbin motion toward the nozzle, thus avoiding the risk of damaging the outer layer of the yarn winding.

The time interval is preferably measured from the moment of the return of the mouth of the detecting nozzle to its detecting position that is unambiguously defined thus ensuring each time the exact bobbin setting in the detecting position.

Advantageously, the speed of the bobbin movement in the mouth of the detecting nozzle is greater than the speed of its reverse motion. This reduces the length of time required to attend one operating unit of the machine. Yet, due to the slow reverse motion of the bobbin, this permits a fine adjustment of the distance between the bobbin circumference and the mouth of the detecting nozzle.

A still finer adjustment of the distance between the bobbin circumference and the mouth of the detecting nozzle can be obtained by keeping constant at least the speed of the reverse motion of the bobbin.

In one variant of the method of the invention, the mouth of the detecting nozzle lies between the bobbin and the drive cylinder of the winding device after the detecting device has reached the detecting position.

In another variant of the method, during the travel of the detecting device to its detecting position, the mouth of the detecting nozzle moves into the path of the possible bobbin tube motion on the bobbin side opposite to the drive cylinder. The mouth of the detecting nozzle in its detecting position lies in that path.

The principle of the attending device for carrying out the method is that the attending device is fitted with a sensor which monitors the position of the detecting nozzle after the detecting nozzle has reached its detecting position for the first time and that the mouth of the detecting tube is adapted to move towards the bobbin and away from it.

The mouth of the detecting nozzle can be made as a compressible member.

In another variant of that embodiment, the front part of the nozzle can carry an elastic flexible member.

In still another variant of that embodiment, the detecting nozzle can be seated on a swinging arm so as to be able to swing from its detecting position in the direction away from the bobbin.

Because the mouth of the detecting nozzle swings from the detecting position when the bobbin comes into contact with the mouth, this protects the outer yarn windings from being damaged by hard impact with the nozzle.

In the last mentioned embodiment, the means monitoring the position of the mouth of the detecting nozzle is preferably related to the detecting nozzle. In this embodiment, the means monitoring the position of the mouth of the detecting nozzle can be made as a contact sensor which is seated between the swinging arm and the detecting nozzle. In this last mentioned case, it is advantageous for technical design reasons to fix the contact sensor on the swinging arm and in such a manner that it is in contact with the detecting nozzle when the nozzle mouth is in its detecting position.

Other objects, features and advantages of the present invention will become apparent from the following description of the invention which refers to the accompanying drawings.

BRIEF DESCRIPTION OF THE DRAWINGS

Exemplary embodiments of devices for carrying out the method of the invention are schematically shown in the accompanying drawings in which:

FIG. 1 shows the bobbin lifted and shows the detecting nozzle in its detecting position; FIG. 2 shows the detecting nozzle deflected from the detecting position in the direction of bobbin motion after having been contacted by the bobbin;

FIG. 3 shows reverse motion of the bobbin when the detecting nozzle has resumed its detecting position;

FIG. 4 shows the end stage of the reverse motion of the bobbin which creates a desired gap between the bobbin and the mouth of the detecting nozzle;

DETAILED DESCRIPTION OF THE INVENTION

Figure 1:
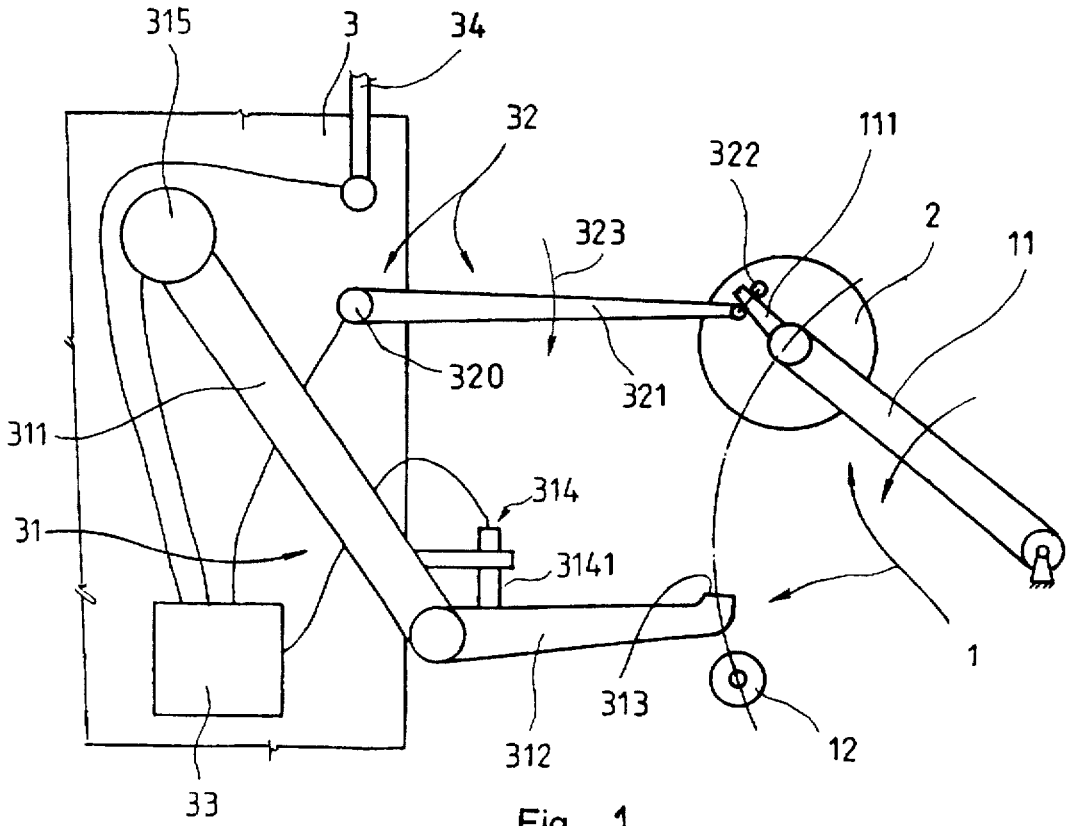
FIGS. 1 to 4 show a part of the mechanisms of the attending device according to a first embodiment and the winding device of the machine, and in particular.
Figure 2:
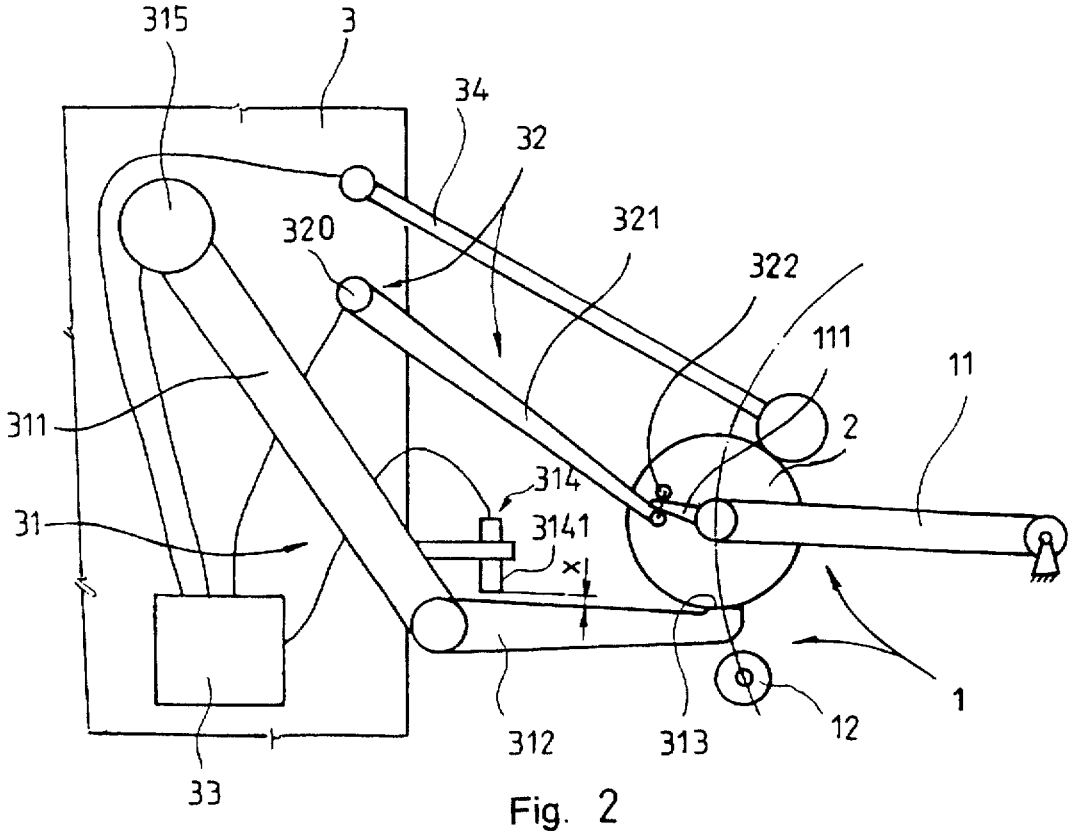
Figure 3:
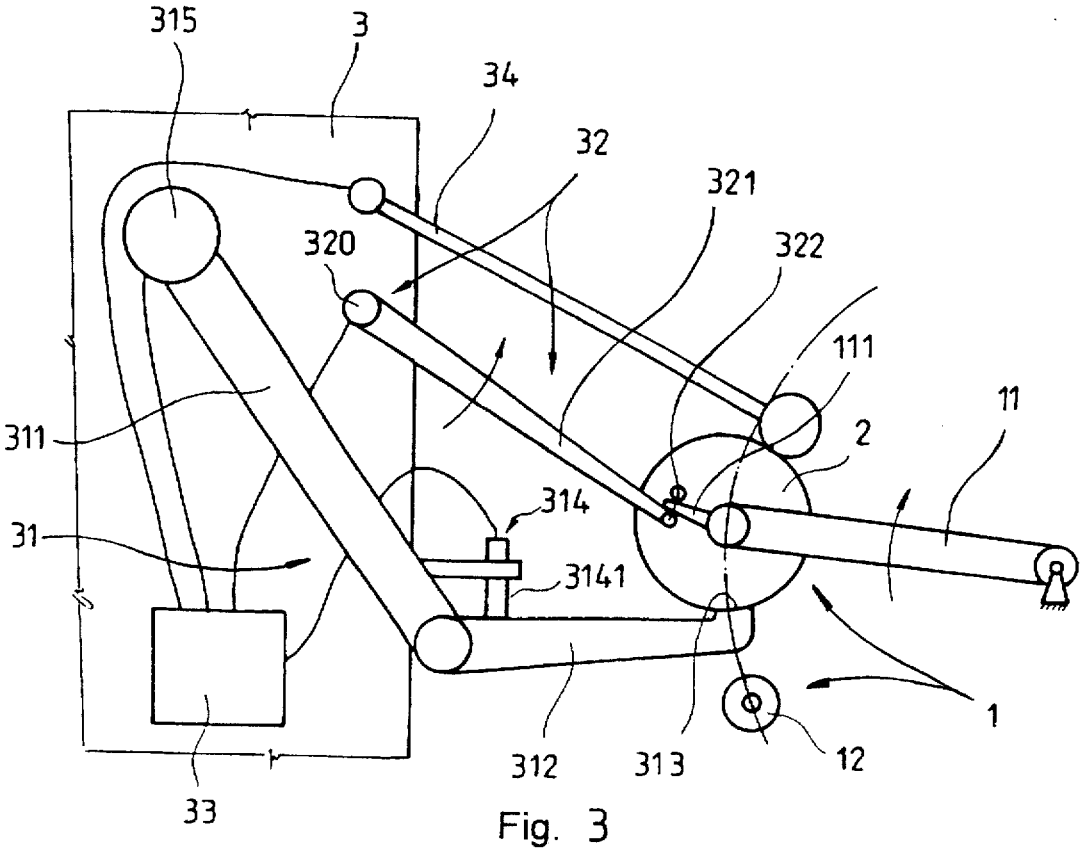
Figure 4:
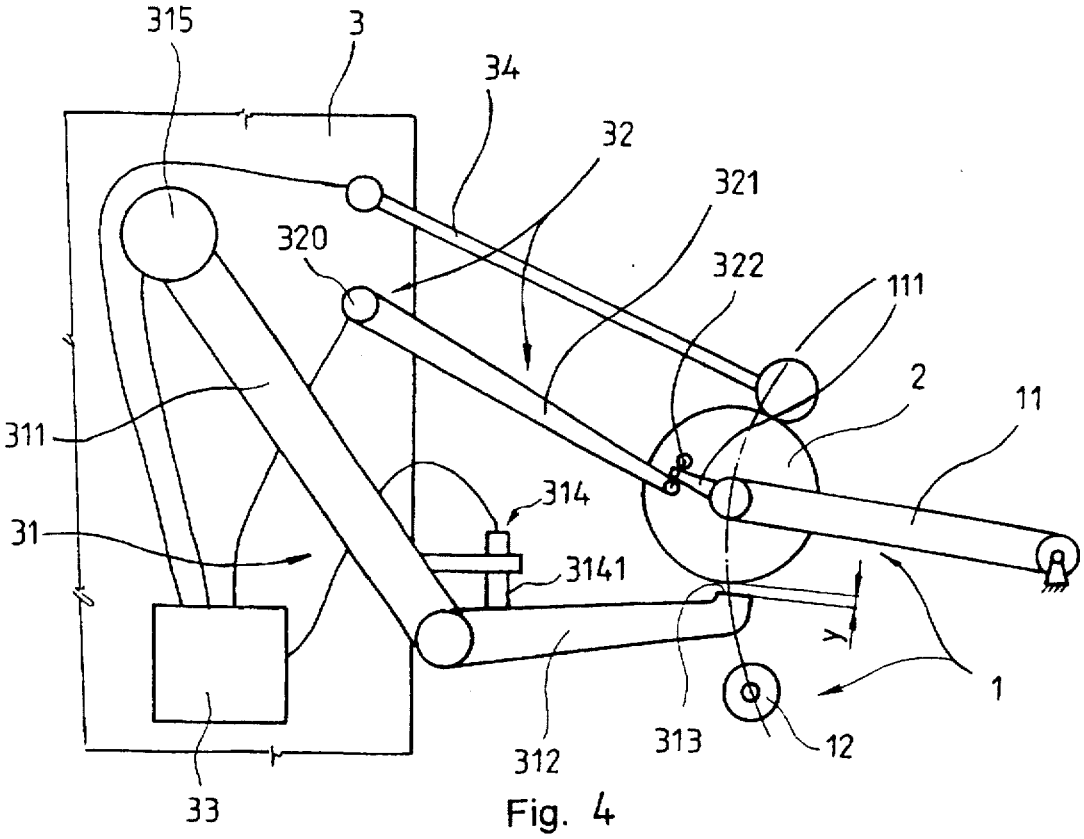

Exemplary embodiments of the invention are explained with reference to an open-end spinning machine having a plurality of operating units that are situated next to each other. Each operating unit comprises a winding device 1 for winding yarn (not shown) on a bobbin 2. The winding device 1 has a well known design and comprises a pair of winding arms 11 between which the bobbin 2 is mounted for rotation in a well-known way. During winding the bobbin 2 is at a lowered location, with reference to FIG. 1, in contact with a drive cylinder 12. The winding arms 11 are mounted so as to swing on an axis parallel to the drive cylinder 12.

If the yarn supply to the winding device 1 is interrupted or ruptured, the winding arms 11 with the bobbin 2 swing upward to remove the bobbin 2 out of contact with the drive cylinder 12.

To correct for a yarn rupture, an attending device 3 is arranged in a well-known way so as to travel along the operating units of the machine and to stop at an operating unit where there has been a yarn rupture or interruption. The device 3 comprises many mechanisms attending various well-known functional parts of the operating units and a detecting device 31 for detecting the yarn end on the lifted bobbin 2.

In the embodiment shown in FIGS. 1 to 4, the detecting device comprises a hollow swinging arm 311 mounted for rotation (swinging motion) on the attending device 3 and coupled with a well-known drive means 315. The cavity of the hollow swinging arm 311 is in a well known way adapted to be connected to and disconnected from a not shown underpressure source. A hollow detecting nozzle 312 is mounted for rotation on the hollow swinging arm 311. The nozzle 312 terminates in a slot shaped mouth 313. The cavity of the detecting nozzle 312 communicates with the cavity of the swinging arm 311. In the first embodiment shown in FIGS. 1 to 4, the mouth 313 of the detecting nozzle 312 reaches in the swung position of the swinging arm 311 between the lifted bobbin 2 and the drive cylinder 12 of the winding device 1. This positions the mouth 313 of the detecting nozzle 312, as well as the detecting nozzle 312, in their detecting position as shown in FIG. 1 now ready to attend to the bobbin with the yarn interruption. The detecting position of the detecting nozzle 312 is defined in the direction facing towards the lifted bobbin 2. The detecting nozzle 312 on the detecting arm 311 is mounted swingingly from its basic position in the direction from the lifted bobbin 2. The detecting device is equipped with well known not shown means biasing the detecting nozzle 312 with a force acting in the direction towards the lifted bobbin 2 thus keeping the detecting nozzle 312 in its detecting position.

These biasing means can, for instance, comprise a torsion spring having one end which is fixed on the detecting nozzle 312 and the other end fixed on the detecting arm 311, or the biasing means can be made as special means of the attending device 3 or in another well-known manner.

A monitoring means 314 is mounted on the attending device 3 for monitoring the detecting position of the detecting nozzle 312. In the embodiments shown in FIGS. 1 to 5, the monitoring means comprises a contact sensor 3141 which is fixed to the swinging arm 311 and in a well-known way is connected to a well known control unit 33 of the attending device. The drive means of the swinging arm 311 are connected with the attending device as well as with the means for connecting and disconnecting the underpressure source with the cavity of the swinging arm 311 or of the detecting nozzle 312.

The attending device 3 also has control means 32 for the winding arms 11 comprising a control lever 321 adapted to pivot on the attending device 3. The control lever 321 is coupled with a well-known drive 320 which is coupled in turn with the control unit 33. On the control lever 321, and preferably on its extremity, there is a catch means 322 of the winding arms 11 which connects the control lever 321 with one of the two winding arms 11.

In the embodiment shown in FIGS. 1 to 4, the extremity of one of the winding arms 11 has a projection 111 that in the lifted position of the bobbin 2 is situated in the path of rotation of the catch means 322 of the control lever 321 in the direction upwards towards the bobbin 2, as shown by the arrow 323 in FIG. 1 and the projection 111 receives the catch means 322. The mutual positions and shapes of the catch means 322 of the control lever 321 and of the projection 111 of the winding arm 11 prevents the projection 111 from falling out of the catch means 3 during the travel of the bobbin 2 towards the detecting nozzle 312. The catch means 322 of the control lever 32 can also be adapted for catching the projection 111 of the winding arm 11 during the movement of the control lever 32 upwards.

The attending device 3 is also fitted with a well-known auxiliary drive means 34 for the bobbin 2 which is adapted to be moved into contact with the circumference of the bobbin 2 and to impart rotary motion to the bobbin 2 in each direction when a yarn end is to be found.

Figure 5:
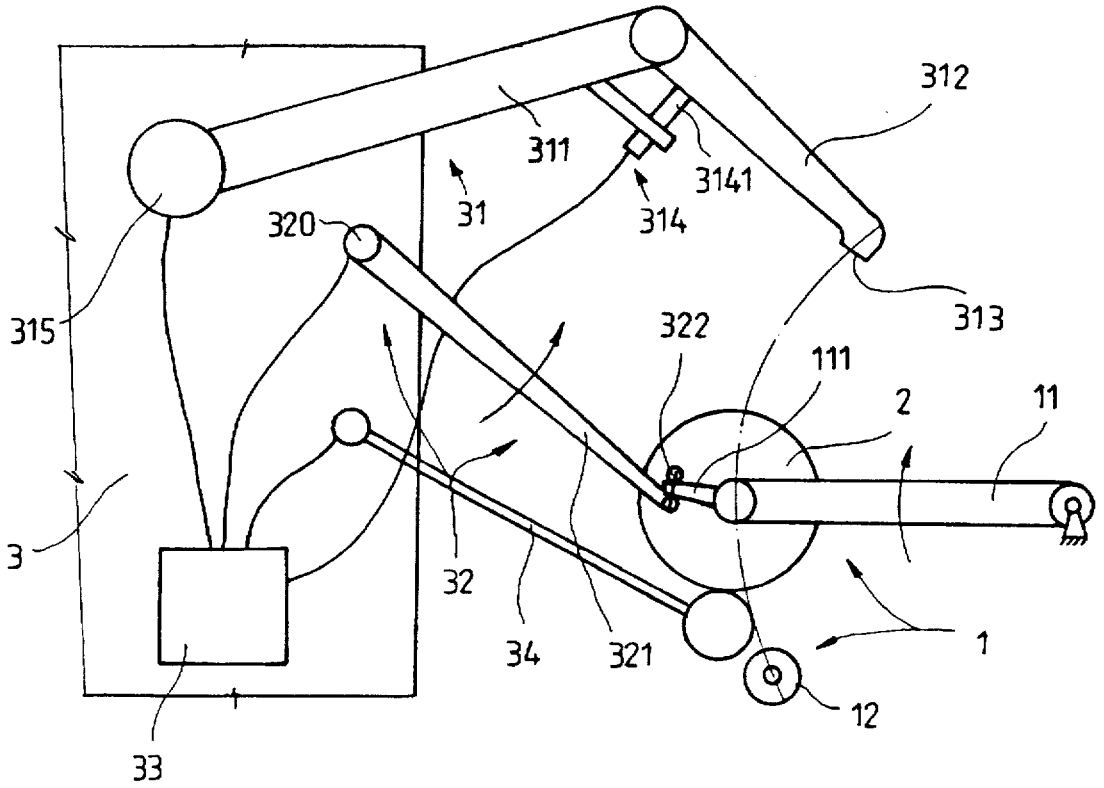
FIG. 5 shows a part of the mechanisms of the attending device according to a second embodiment.

In the other embodiment shown in FIG. 5, the mouth 313 of the detecting nozzle 312 is adapted to be swung into the path of travel of the tube 21 of the bobbin 2 being wound on the side of the bobbin 2 opposite to that of the drive cylinder 12. The other means of the attending device 3 in this embodiment are analogous to the other embodiments.

Every operating unit of the machine is also fitted with well-known but not shown means monitoring yarn rupture. If such rupture occurs, the spinning process of the affected operating unit is interrupted, and the bobbin 2 being wound is removed by well known means out of contact with the drive cylinder 12, and in some cases the bobbin rotation is also stopped. In the illustrated embodiments, the bobbin 2 being wound is disengaged from the drive cylinder 12 by being moved upwards.

The yarn rupture correction on the affected operating unit is carried out by the attending device 3 which is adapted to travel along the operating units of the machines. The attending device detects in a well known way those operating units in need of attendance and stops at them. In the first stage of the yarn rupture correction, the attending device 3 must detect the yarn end on the bobbin 2. To do that, the detecting device 31 of the attending device 3 shown in FIGS. 1 to 4 is set to its detecting position. The drive means 315 rotates (swings) the swinging arm 311 towards the machine until the swinging arm 311 reaches its end position in which the mouth 313 of the detecting nozzle 312 lies in the travel path described by the tube 21 of the bobbin 2 during the downward rotation (swinging) of the swinging arms 11 of the winding device 1. In this detecting position, the mouth 313 of the detecting nozzle 312 is situated between the drive cylinder 12 and the lifted bobbin 2 while the monitoring means 314 monitors the position of the detecting nozzle 312 with respect to the swinging arm 311 and gives to the control unit 33 a signal relating to the basic position of the detecting nozzle 312 with respect to the swinging arm 311.

At the same time or in another suitable time sequence, the drive of the control means 32 of the winding arms 11 is activated. This begins to turn the control lever 321 towards the winding device 1 until the catch means 322 is pushed onto the projection 111 of the winding arm 11.

When the catch means 322 has been pushed onto the projection 111 of the winding arm 11, the winding arms 11 holding the bobbin 2 are coupled with the control lever 321 which then continues its rotary motion in the same direction until the circumference of the bobbin 2 is brought into contact with the mouth 313 of the detecting nozzle 321. Upon this contact, the detecting nozzle 312 is swung in the direction of the motion of the bobbin 2 and moves with the bobbin. The impact of that contact is absorbed, avoiding damage to the yarn on the bobbin, for example. This swing of the nozzle disconnects the contact sensor 3141 which is acting as the monitoring means 314 monitoring the mutual position of the swinging arm 311 and of the detecting nozzle 312. The monitoring means 314 transmits a signal to the control unit 33 which stops the rotation of the drive 320 of the control lever 321 of the winding arms 11 and starts this drive 320 rotating in the reverse (opposite) direction. This means that movement of the control lever 321 and of the coupled parts continues for a time interval after the bobbin 2 first contacts the mouth 313 of the detecting nozzle before that movement stops. At the moment when the movement of the control lever 321 and of the bobbin 2 stop, the detecting nozzle 312 has been swung out of its detecting position, and its mouth 313 is in contact with the circumference of the bobbin 2 to which it is pressed by a small force.

During the following reverse motion of the control lever 321 of the control means 32, all the elements move in the directions towards their original positions. The mouth 313 of the detecting nozzle 312 is in contact with the circumference of the bobbin 2 in the initial stage of this movement. At the moment when the detecting nozzle 312 sits on the contact sensor 3141 which acts in this embodiment as monitoring means 314, reverse motion of the nozzle is stopped and the mouth 313 of the detecting nozzle 312 loses contact with the surface of the bobbin 2. The control lever 321 of the control means 32 continues its reverse motion to displace the bobbin 2 farther from the mouth 313 of the detecting nozzle 312.

When contact between the circumference of the bobbin 2 and the mouth 313 of the detecting nozzle 312 ceases, the monitoring means 314 sends information about this condition to the control unit 33 of the attending device 3. The control unit 33 then monitors the further reverse motion of the control lever 321 of the control means 32 and, consequently, monitors the time interval of the reverse motion of the bobbin 2, and it stops this reverse motion at the end of a predetermined time interval. If this time interval and the reverse motion speed of the lever 321 are both constant, the bobbin 2 always stops with its circumference at a constant distance from the mouth 313 of the detecting nozzle 312.

The time interval of the reverse motion of the bobbin can be measured, and control over the functions of the mechanisms of the attending device 3 can be carried out also by other means.

At the latest, at the moment when the reverse motion of the control lever 321 of the control means 32 of the winding arms 11 comes into contact with the circumference of the bobbin 2, the auxiliary drive means 34 of the bobbin 2 is set in motion and it begins to turn the bobbin 2 in the unwinding direction in order to unwind the bobbin and enable the yarn end detecting process on the bobbin 2 to start. However, the auxiliary drive means 34 of the bobbin 2 is moved into contact with the circumference of the bobbin 2 preferably before the beginning of the reverse motion of the control lever 321, and is set in motion as soon as possible after the loss of contact between the mouth 313 of the detecting nozzle 312 and the circumference of the bobbin 2.

The drive 320 of the control lever 321 can have various velocities. For instance, it may comprise an air cylinder whose speed during the motion of the control lever 321 towards the mouth 313 of the detecting nozzle 312 is greater than its speed during the reverse motion of the control lever. It is advantageous if the speed is constant at least during motion of the control lever 321.

During the previous operation, the control unit 33 connects the cavity of the detecting nozzle 312 to the underpressure source. This connection must be carried out at the latest at the moment when the reverse motion of the control lever 321 has stopped and the auxiliary drive means 34 has been set in motion. In the embodiments in which the auxiliary drive means 34 is set in motion prior to halting the reverse motion of the control lever 321, it is more convenient to apply underpressure to the detecting nozzle 312 before the auxiliary drive means 34 has been set in motion.

However, it is technologically simpler to apply underpressure to the detecting nozzle 312 at any time before or during the first motion of the detecting nozzle 312 to its detecting position. In this embodiment, the underpressure in the detecting nozzle 312 is already active during the motion of the bobbin 2 towards the mouth 313 of the detecting nozzle 312. Therefore as long as the yarn end freely hangs from the bobbin 2, it can be caught even before the circumference of the bobbin 2 has come to lie upon the mouth 313 of the detecting nozzle 312.

In the embodiment shown in FIG. 5, the detecting nozzle 312 travels into its detecting position in which its mouth 313 lies in the path of the internal tube 21 of the bobbin 2 and on the side of the bobbin 2 opposite that of the drive cylinder 12. In this case, the control means 32 moves the bobbin 2 towards the mouth 313 of the detecting nozzle 312 in the same manner as in the preceding example of embodiment, and the other steps are also analogous.

The means permitting change in the position of the mouth 313 of the detecting nozzle 312 after it contacts the bobbin 2 can be made in several variants. Two possible embodiments of these means are shown in FIGS. 6 and 7.

Figure 6:
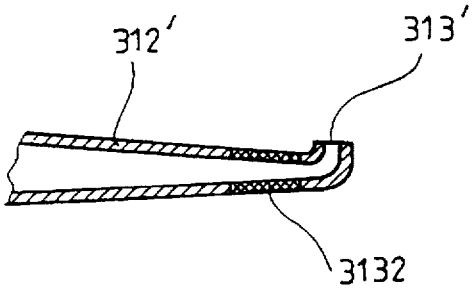
FIG. 6 shows a detecting nozzle with a flexible part.

In the embodiment shown in FIG. 6, the front part of the detecting nozzle 312" has a hollow elastic flexible member 3132 mounted to it which carries the mouth 313' of the detecting nozzle 312'. When the circumference of the bobbin 2 has come into contact with the mouth 313' of the detecting nozzle 312', continuing motion of the bobbin 2 in the same direction will bend or otherwise change the shape of the elastic flexible member 3132. During the following reverse motion of the bobbin 2, the elastic flexible member 3132 resumes its initial shape and thus brings the mouth 313' of the detecting nozzle 312' back to its detecting position.

Figure 7:
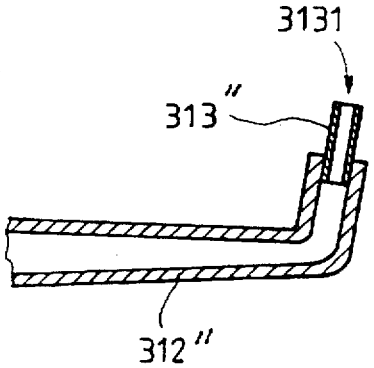
FIG. 7 shows a detecting nozzle with a retractable mouth.
Figure 8:
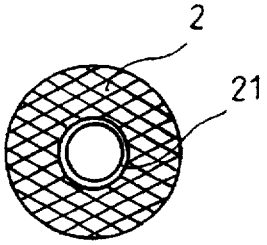
FIG. 8 shows a side view of a wound bobbin.

In the embodiment shown in FIG. 7, the mouth 313" of the detecting nozzle 312" is comprised of a compressible member 3131. When the circumference of the bobbin 2 contacts the mouth 313" of the detecting nozzle 312", the continuing motion of the bobbin 2 in the same direction forces the compressible member 3131 into the detecting nozzle 312". During the following reverse motion of the bobbin 2, the compressible member 3132 resumes its initial position, thus bringing the mouth 313" of the detecting nozzle 312" back to its detecting position.

By equipping the detecting device 31 or the attending device 3 with well-known, not shown means monitoring the distance between the circumference of the bobbin 2 and the mouth 313 of the detecting nozzle 312, for instance by optical sensors, the circumference of the bobbin 2 can softly contact the mouth 313 of the detecting nozzle 312 so that only the circumference of the bobbin 2 comes to lie on the mouth 313 of the detecting nozzle 312, whereupon the bobbin stops and then begins to turn in the reverse direction, while the reverse motion of the bobbin 2 starts at the moment of the loss of contact between the circumference of the bobbin 2 and the mouth 313 of the detecting nozzle 312.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for detecting a yarn end on a bobbin having a central tube and supported in a winding device of an operating unit of a textile machine, wherein the textile machine comprises a plurality of operating units situated next to each other and comprises an attending device which attends to a selected operating unit at which there is a yarn interruption, and the attending device is fitted with a detection device provided with a detecting nozzle having a yarn sucking mouth, the method comprising:

displacing the detecting device over the textile machine and into a detecting position;

moving the mouth of the detecting nozzle to lie in the path of possible motion of the central tube of the bobbin;

moving the bobbin in one direction toward the mouth of the nozzle, such that when the bobbin mounted in the winding device moves toward the mouth of the detecting nozzle which is in the detecting position, and when the circumference of the bobbin comes to lie on the mouth, the bobbin moves against the mouth of the nozzle, the mouth of the nozzle is moved along with the bobbin in the direction of the motion of the bobbin;

upon contact between the bobbin and the mouth of the nozzle, stopping the movement of the bobbin in the one direction and moving the bobbin in the reverse direction wherein the mouth of the nozzle is remaining in contact with the circumference of the bobbin until the mouth of the nozzle has returned to the detecting position;

then stopping the reverse direction motion of the nozzle which is moving along with the return of the bobbin while reverse motion of the bobbin continues;

monitoring the moment of the end of the contact between the bobbin circumference and the mouth of the nozzle;

then moving the bobbin away from the mouth of the nozzle for a predetermined time interval, for thereby assuring there is a constant distance between the circumference of the bobbin and the mouth of the detecting nozzle regardless of the winding diameter of the yarn on the bobbin.

2. The method of claim 1, wherein the time interval of movement of the bobbin away from the mouth of the nozzle is measured starting with the moment that the mouth of the nozzle has returned to the detecting position.

3. The method of claim 1, wherein the bobbin moves in the one direction toward the mouth of the nozzle at a speed that is greater than the speed of the reverse direction movement of the bobbin.

4. The method of claim 1, wherein the speed of the bobbin in at least the reverse direction is a constant speed.

5. The method of claim 1, wherein the winding device further comprises a drive cylinder for driving the bobbin to rotate, and the nozzle is moved to the detecting position by being moved between the bobbin and the drive cylinder of the winding device with the mouth of the nozzle in the detecting position.

6. The method of claim 1, wherein moving the nozzle to the detecting position comprises moving the mouth of the detecting nozzle into the path of the possible motion of the bobbin support tube and at the side of the bobbin opposite to the side of the bobbin at which the drive cylinder is located, wherein the mouth of the detecting nozzle in the detecting position lies in the path of the bobbin.

7. An attending device for a textile machine for operating in association with any of a plurality of operating units situated near each other in the textile machine, wherein each of the operating units includes a winding device with arms for supporting the central tube of the bobbin, the attending device comprising a bobbin yarn detecting device including a swinging arm, a detecting nozzle on the swinging arm, the nozzle having a yarn sucking mouth, the nozzle being connectable to an underpressure force;

the winding device of the textile machine including a winding arm which supports a bobbin, the winding arm being operable along a movement pathway; moving means for engaging and moving the winding arm of the winding device for moving the bobbin in one direction toward and in the reverse direction away from the mouth of the detecting nozzle;

upon the bobbin moving toward and engaging the mouth of the detecting nozzle, the bobbin being moveable together with the mouth of the detecting nozzle for a distance in the one direction; the means for moving the winding arms also being operable for moving the bobbin away from the mouth of the detecting nozzle after the nozzle mouth and the bobbin have stopped moving in the one direction;

monitoring means on the attending device for monitoring the position of the mouth of the detecting nozzle at least after the detecting nozzle has been moved along with the bobbin in the reverse direction and the mouth of the nozzle has returned to its detecting position.

8. The attending device of claim 7, wherein the monitoring device also monitors the position of the detecting nozzle after it has reached the detecting position.

9. The attending device of claim 7, wherein the mouth of the detecting nozzle comprises a compressible member compressible upon engaging the circumference of the bobbin.

10. The attending device of claim 7, wherein the mouth of the nozzle includes an elastic flexible member which is flexed upon engaging the circumference of the bobbin.

11. The attending device of claim 7, wherein the detecting nozzle being seated on the swinging arm for being swung by the swinging arm from its detecting position in both of the one and reverse directions.

12. The attending device of claim 11, wherein the monitoring means for monitoring the position of the mouth of the detecting nozzle is connectable with and operable by movement of the detecting nozzle.

13. The attending device of claim 12, wherein the monitoring means comprises a contact sensor between the swinging arm and the detecting nozzle for monitoring the position of the mouth of the nozzle.

14. The attending device of claim 13, wherein the contact sensor is in fixed on the swinging arm and is contact with the detecting nozzle when the detecting nozzle is in the detecting position.

15. The attending device of claim 14, wherein the contact sensor is so positioned as not to be in contact with the detecting nozzle when the detecting nozzle has been moved out of the detecting position by its contact with the bobbin.

16. The attending device of claim 12, wherein the monitoring means is so positioned as not to be contact with the detecting nozzle when the detecting nozzle has been moved out of the detecting position by its contact with the bobbin.

* * * * *